US006230936B1

(12) United States Patent
Lasko

(10) Patent No.: US 6,230,936 B1
(45) Date of Patent: May 15, 2001

(54) FOLDED SUSCEPTOR FOR GLUE GUN

(76) Inventor: Bernard C. Lasko, 2605 Colonial Pkwy., Fort Worth, TX (US) 76109

( * ) Notice: Subject to any disclaimer, the term of this patent is extended or adjusted under 35 U.S.C. 154(b) by 0 days.

(21) Appl. No.: 09/470,647

(22) Filed: Dec. 22, 1999

Related U.S. Application Data

(60) Provisional application No. 60/113,448, filed on Dec. 23, 1998.

(51) Int. Cl.[7] ..... B67D 5/62

(52) U.S. Cl. ..... 222/146.5; 239/85; 219/426; 219/634; 219/635; 219/674

(58) Field of Search ..... 239/81, 85, 135; 219/420, 426, 633, 634, 635, 674; 222/146.5

(56) References Cited

U.S. PATENT DOCUMENTS 4,664,296 * 5/1987 Dziki ..... 222/146.6
4,948,944 * 8/1990 Oster ..... 222/146.6 X
5,584,419 12/1996 Lasko .

* cited by examiner

*Primary Examiner*—Kenneth Bomberg
(74) *Attorney, Agent, or Firm*—Bracewell & Patterson LLP; James E. Bradley

(57) ABSTRACT

An apparatus such as a glue gun system that utilizes either a stick or solid beads of meltable material such as glue. A motor in the interior of a body of the glue gun drives a drive member. The drive member forces the meltable material towards a nose assembly on the forward end of the body. An inductor and susceptor are provided in the nose assembly to transfer heat to the meltable material. The susceptor has multiple folds to increase the surface area of the susceptor and the rate of heat transfer to the meltable material. Electronics control the drive member and control the power to the inductor.

10 Claims, 5 Drawing Sheets

FOLDED SUSCEPTOR FOR GLUE GUN

CROSS-REFERENCE TO RELATED APPLICATIONS

This application claims the benefits of provisional application Ser. No. 60/113,448, filed Dec. 23, 1998, in the United States Patent & Trademark Office.

TECHNICAL FIELD

A method and apparatus for delivering melted material. More particularly, the apparatus is a glue gun utilizing a specially designed susceptor for increasing heat transfer to meltable material and, therefore, a production rate of melted material.

BACKGROUND OF THE INVENTION

Prior art devices have been utilized for heating and dispensing materials, such as for heating a solid material until it melts and then dispensing the material as a liquid. For example, hot glue guns are used for heating an end of a solid glue stick to a transition temperature at which the glue is liquified and then dispensing the melted glue through a dispensing orifice. Typically, a body is provided having an interior flow path through which the material is pushed as it is heated. Resistance heating elements are commonly used. The resistance heating elements have been mounted to the body outside of the flow path, and often outside of the body.

Other devices have utilized induction heating to heat materials for dispensing. A body is usually provided having an interior flow path through which the material is pushed as it is heated. An electromagnetically heated susceptor is located either directly in or immediately adjacent to the material flow path. Induction coils have been mounted outside of the body for inducing eddy currents to flow within the susceptor to generate heat for transferring to the materials. Often an external shroud is provided around the induction coil to protect an operator.

SUMMARY OF THE INVENTION

A glue gun system converts solid meltable glue into liquid glue for use on a work piece. In one embodiment the glue gun utilizes a stick of meltable material inserted within a body of the glue gun. In a second embodiment, the glue gun utilizes solid beads of glue that are delivered from a hopper, through a hose and to a body of the glue gun. In a second embodiment, the glue gun utilizes a stick of meltable material inserted within a body of the glue gun.

A nose assembly is provided on the forward end of the body. The nose assembly has a conical housing cone with a central orifice for delivery of the melted material to a workpiece. A conical inductor is received within the conical housing cone and also has a central orifice. The inductor is preferably a coil that surrounds the susceptor for heating a susceptor. The conical susceptor is received within the conical inductor. The conical susceptor has a plurality of holes formed thereon and defines a central orifice. The conical susceptor is electrically conductive and has folds to provide greater surface area for increasing heat transfer. The folds extend lengthwise from a base of the susceptor to an apex of the susceptor for increasing a ratio of surface area to mass. The folds, therefore, increase a speed of heat transfer from the susceptor to the meltable material. A conical displacement cone is received within the conical susceptor. A nozzle is positioned within the central orifice of the conical housing, the conical inductor and the conical susceptor. The nozzle permits a flow of meltable material through a plurality of peripheral passages. The peripheral passages are sized to permit a flow of meltable material under pressure but not to permit a flow of material when not under pressure.

DETAILED DESCRIPTION OF THE INVENTION

Figure 1:
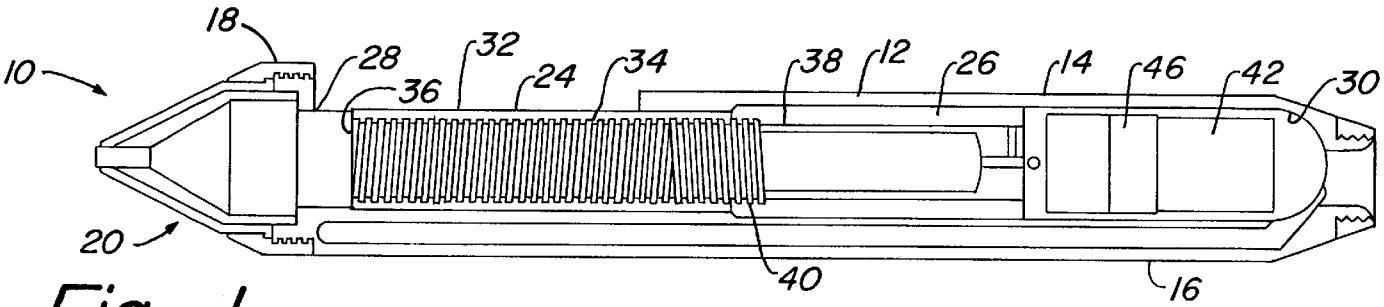
FIG. 1 is a side cross-sectional view of a first embodiment of a glue gun of the invention, wherein the pusher is partially advanced.
Figure 2:
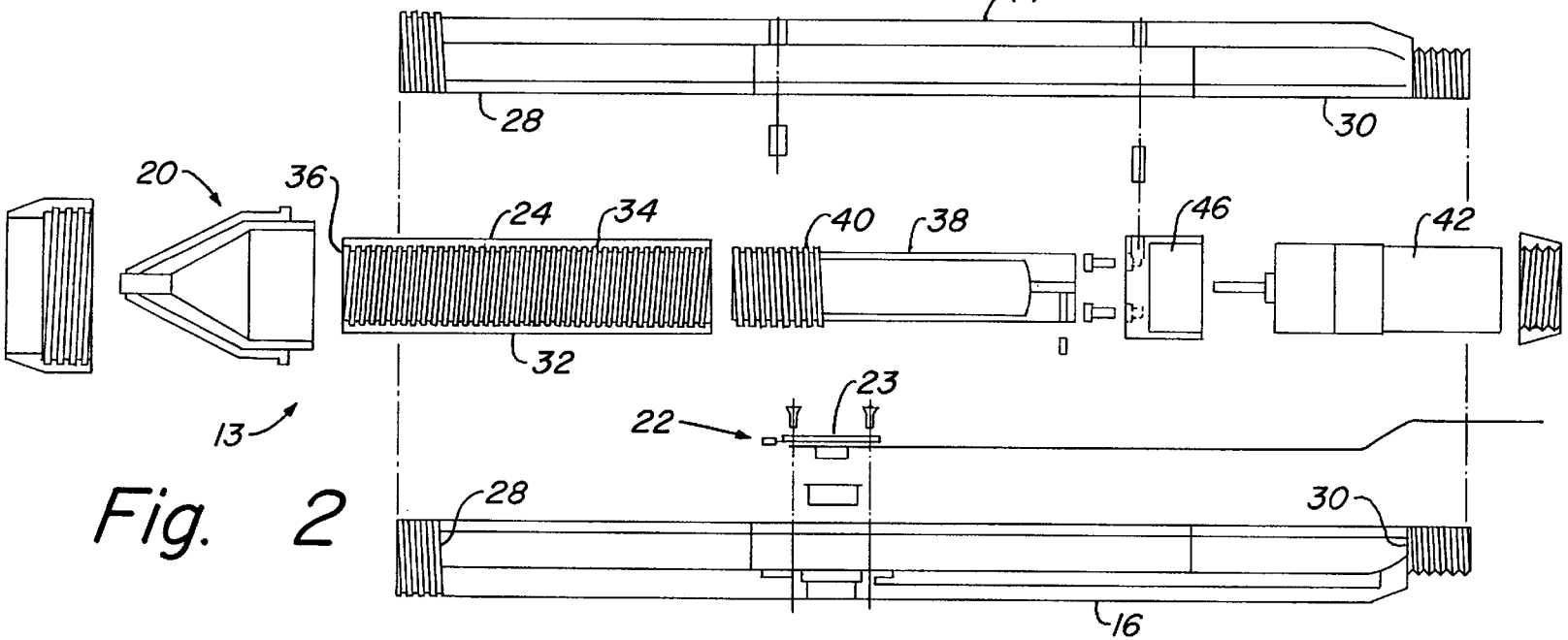
FIG. 2 is an exploded cross-sectional view of the glue gun of FIG. 1.
Figure 3:
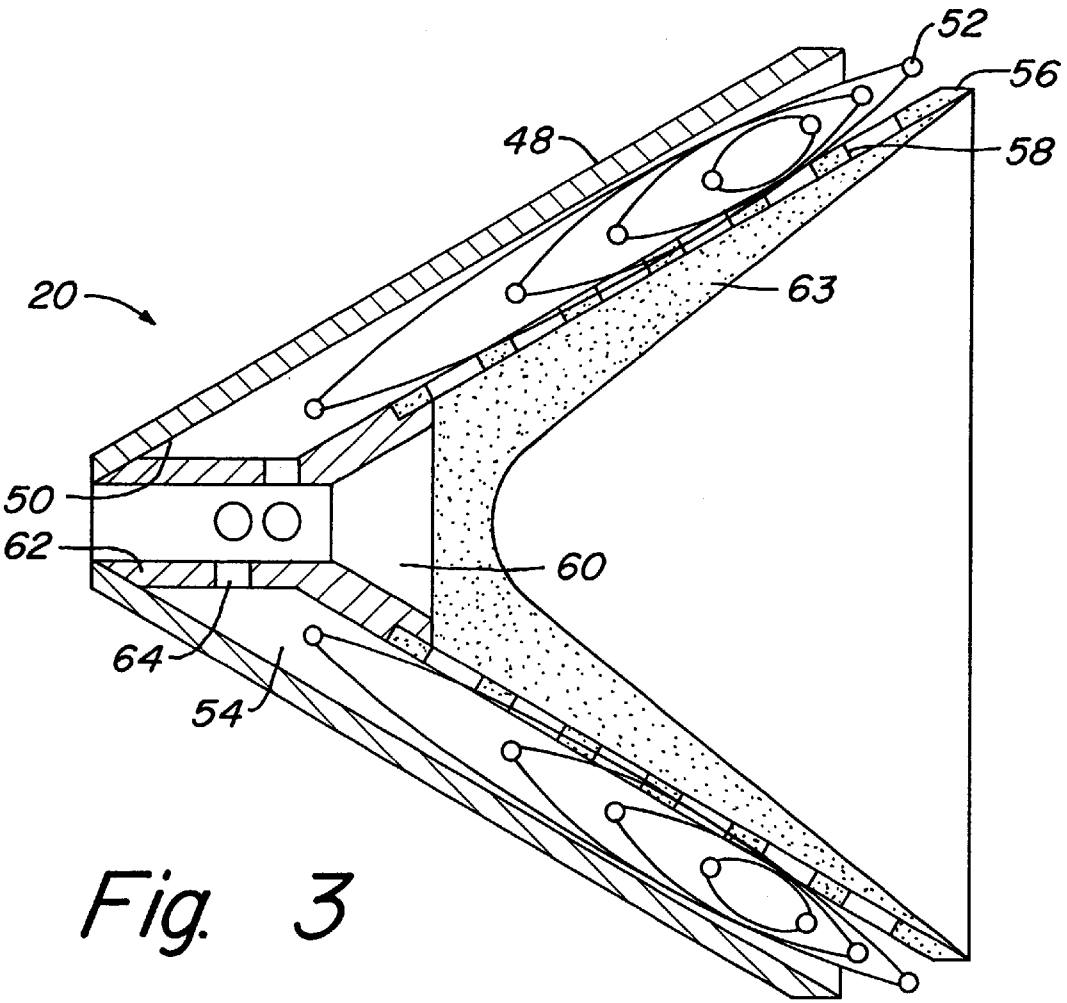
FIG. 3 is an enlarged cross-sectional view of the nose assembly of the glue gun of FIGS. 1 and 2.

Referring now to FIGS. 1–3, a glue gun designated generally 10, is shown. Glue gun 10 is used for heating, liquefying and dispensing meltable material, preferably solid sticks of glue that typically measure one inch in diameter and three inches in length. Glue gun 10 has a body 12, which is preferably approximately cylindrical in shape and is made up of a top half 14 and a bottom half 16. Body 12 has a forward end 18 and a nose assembly 20. A trigger mechanism 22 controls heating and dispensing of the hot glue. A power cord extends from body 12 and connects to a power supply (not shown), which is preferably a 110 volt AC power source. Power is preferably controlled by a power supply PC board 23 (FIG. 2).

Pusher 24 provides a means for pushing a glue stick towards nose assembly 20. Pusher 24 is slidably received within an interior cavity 26 of body 12 and has a forward end 28 and a rearward end 30. When the pusher 24 is fully retracted, cavity 26 is accessible for loading a glue stick or other meltable material (not shown). The pusher 24 is made up of an internally threaded cylinder 32 having internal threads 34 and an end surface 36 for engaging a meltable material and advancing the meltable material toward the nose assembly 20. The pusher 24 is advanced and retracted by an externally threaded driver screw 38, which engages internal threads 34 of internally threaded cylinder 32. Externally threaded driver screw 38 is provided with external threads 40. The externally threaded driver screw 38 is rotated by motor 42, which is preferably a 24 volt electric motor. Motor 42 receives power by a power cord (not shown). Motor 42 is operatively connected to gear head 46, which is affixed to externally threaded driver screw 38.

Nose assembly 20 is affixed to a forward end 18 of body 12 and may be seen in greater detail in FIG. 3. Nose assembly 20 is made up of a conical housing cone 48 having a central orifice 50 formed therein. A conical inductor 52 is received within the conical housing 48, which defines a central orifice 54. Preferably, a low resistance coiled inductor is used for efficiency. A conical susceptor 56 is received within the conical inductor 52 and has a plurality of holes 58 formed therein and defines a central orifice 60. Preferably, susceptor 56 is fabricated from a 22 gage low carbon steel perforated sheet that has a surface area of 3.2 square inches and a weight of 0.130 oz. Susceptor 56 is folded, similar to susceptor 150 of FIG. 6. The folds increase the surface area. The high ratio of surface area to weight provides a rapid transfer of energy from the susceptor 56 to the meltable material while minimizing latent heat when energy transfer is stopped. Additionally, the susceptor design speeds the initial flow and successive flow recoveries. In this embodiment, the susceptor 56 is constructed with a secondary element, a steel conical housing 48.

A nozzle 62 is positioned within central orifices 50, 54 and 60 to deliver melted material for a users application. The nozzle 62 is provided with a plurality of peripheral passages 64 that are sized to permit flow of meltable material under pressure, but prevent flow of melted material that is not under pressure. Most flow through the nozzle 62 enters through the peripheral passages 64, since peripheral passages 64 communicate with an area that defines a gap between the susceptor 56 and conical housing cone 48, which contains most of the melted material. Although a small amount of material enters through passage 60, most of the material in this area is not melted enough to reduce the viscosity of the material sufficiently to enable flow into passage 60.

A dripless "off" cycle is achieved by first relieving elastic pressure at the melt phase 63 in the upstream or rearward direction, and second by minimizing a volume above the orifice in any gun position. Preferably, the gap that houses conical inductor 52, which is between the susceptor 56 and conical housing cone 48 at the apex is approximately 0.060". Thirdly, the dripless "off" cycle is achieved by passing the liquid material through a plurality of small peripheral passages 64 at the entry of the delivery passage in nozzle 62. The aggregate area of peripheral passages 64 needs to exceed the delivery orifice area so that the peripheral passages 64 do not impede the volume delivery at the design pressure resulting from force applied by the pusher 24.

The combination of the motor 42 and gear head 46 results in a motor gear head speed/torque combination that provides an adequate force to a 1" diameter stick face to deliver 8#/hr of a specified viscosity material through perforated susceptor 56 and a delivery nozzle 62. The force on the pusher 24 is not to exceed the ability of the continuous high frequency power available at the melt phase to raise the temperature of the stick to a design point (preferably 400° F.). The force on pusher 24 should also not exceed a level of safety with respect to a possible finger pinch point in the open cavity 26 of the body 12. The peripheral passages 64 need to be small enough in individual size to provide a capillary action for the static liquid hot melt, which typically has a 2,000–6,000 CPS viscosity at the delivery temperature. Preferably, peripheral passages 64 are small holes drilled perpendicular to the nozzle axis.

Figure 4:
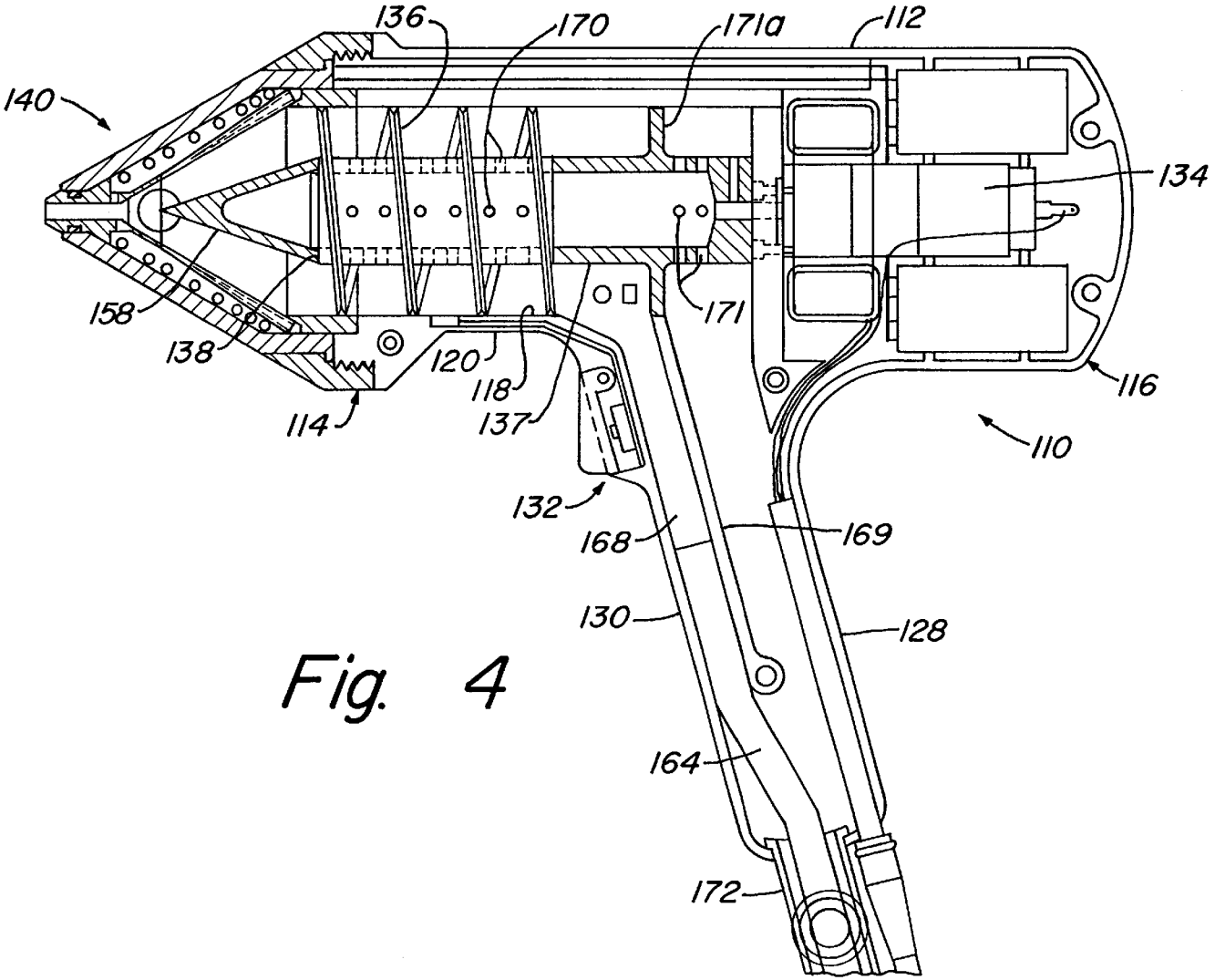
FIG. 4 is an elevational cross-sectional view of a second embodiment of a glue gun of the invention.
Figure 5:
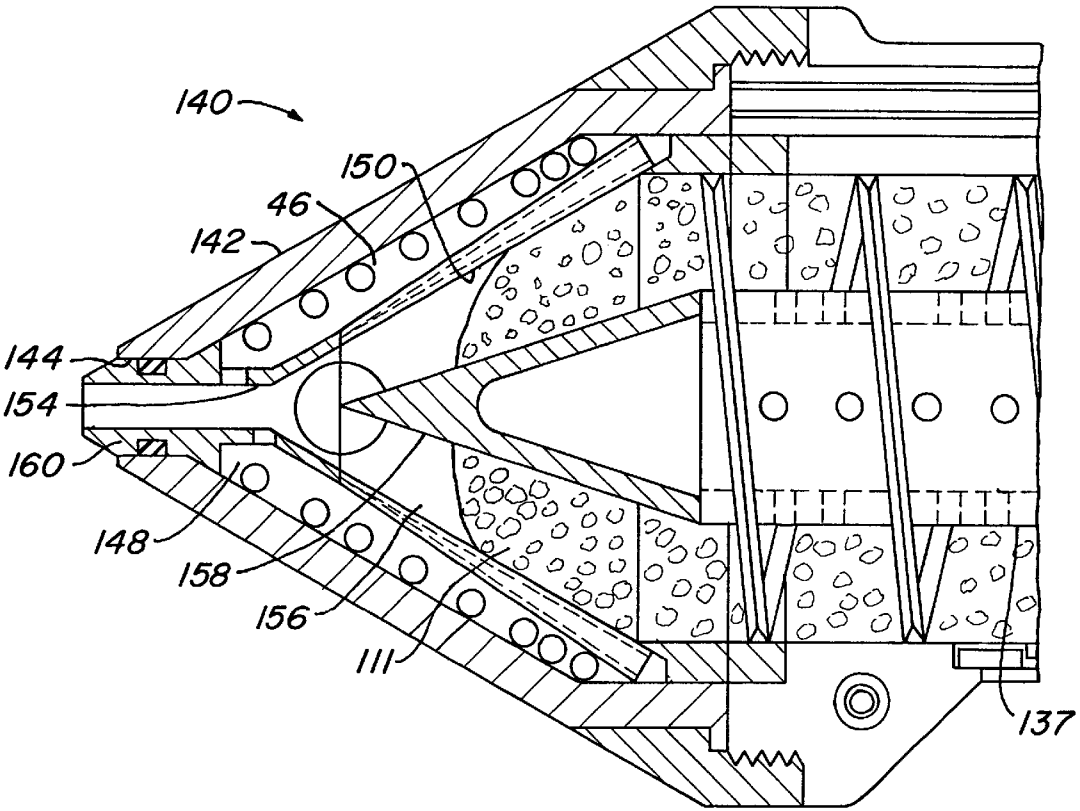
FIG. 5 is an enlarged elevational cross-sectional view of the nose assembly of the glue gun of FIG. 4.

Referring now to FIGS. 4 and 5, a glue gun designated generally 110 utilizes solid beads 111 (FIG. 5) of glue. Glue gun 110 includes a body 112 having a forward end 114, a rearward end 116, an interior 118, and an underside 120. A handle 128 is positioned on underside 120 of body 112. Handle 128 has a forward side 130 having a trigger mechanism 132 positioned thereon. A motor 134 is positioned within interior 118 of body 112. Motor 134 drives an auger or feed screw 136 mounted on a screw barrel 137, which is driven by motor 134. Preferably, the speed of rotation of feed screw 136 may be varied. Screw barrel 137 is rotatably supported on a forward end of stationary cone 158 by a slip joint 138. Feed screw 136 forces beads 111 toward forward end 114 of body 112.

A nose assembly 140 is positioned on forward end 114 of body 112. As seen more clearly in FIG. 5, nose assembly 140 includes a conical housing cone 142 having a central orifice 144. A conical inductor 146 is received within conical housing cone 142. Conical inductor 146 has a central orifice 148. Inductor 146 is a coil of wire.

Figure 6:
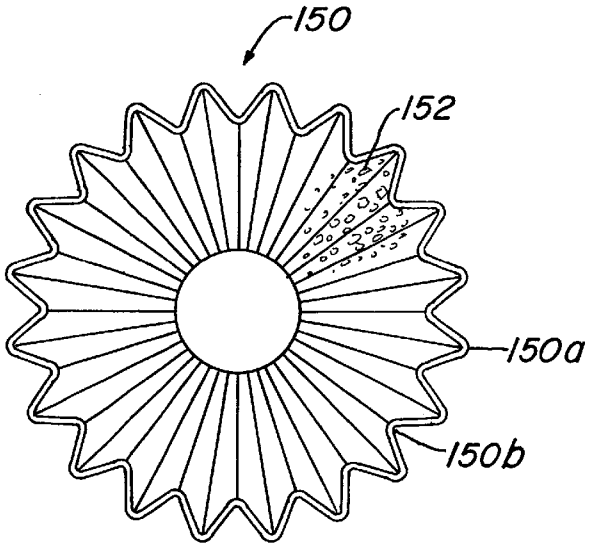
FIG. 6 is an elevational end view of a conical susceptor in the nose assembly of FIGS. 4 and 5.

An electrically conductive conical susceptor 150, shown in greater detail in FIG. 6, is received within conical inductor 146. Conical susceptor 150 is preferably folded or corrugated to provide greater surface area for increased heat transfer. The folds extend lengthwise from the base to the apex of conical susceptor 150. The folded conical susceptor 150 increases the ratio of surface area to mass by 34% over a non-folded conical design. The speed of heat transfer is increased from the surface of susceptor 150 to the beads 111. Preferably, the peaks 150*a* of the corrugations form a 550 angle and the troughs 150*b* form a 73° angle. Conical susceptor 150 is preferably 0.18 inches thick with a plurality of 0.033 inch diameter holes, such that conical susceptor 150 is 28% open. The geometry of the folded susceptor may be formed by die stamping a perforated steel sheet. Preferably, the induced current follows the folded form at the low power density applied (180 watts/sq. inch) in this process. Conical susceptor 150 has a plurality of holes 152 formed thereon. Conical susceptor 150 additionally defines a central orifice 154. Conical susceptor 150 defines an elastic zone 156 (FIG. 5) that is between conical susceptor 150 and beads 111.

Stationary conical displacement cone 158 is received within conical susceptor 150 and slidingly receives a forward end of screw barrel 137. The forward end of displacement cone 158 is supported rearward of orifice 154. A nozzle 160 is positioned within central orifices 144 and 148. A power cable (not shown) is operatively connected with the conical inductor 146 and with a power source (not shown).

Figure 7:
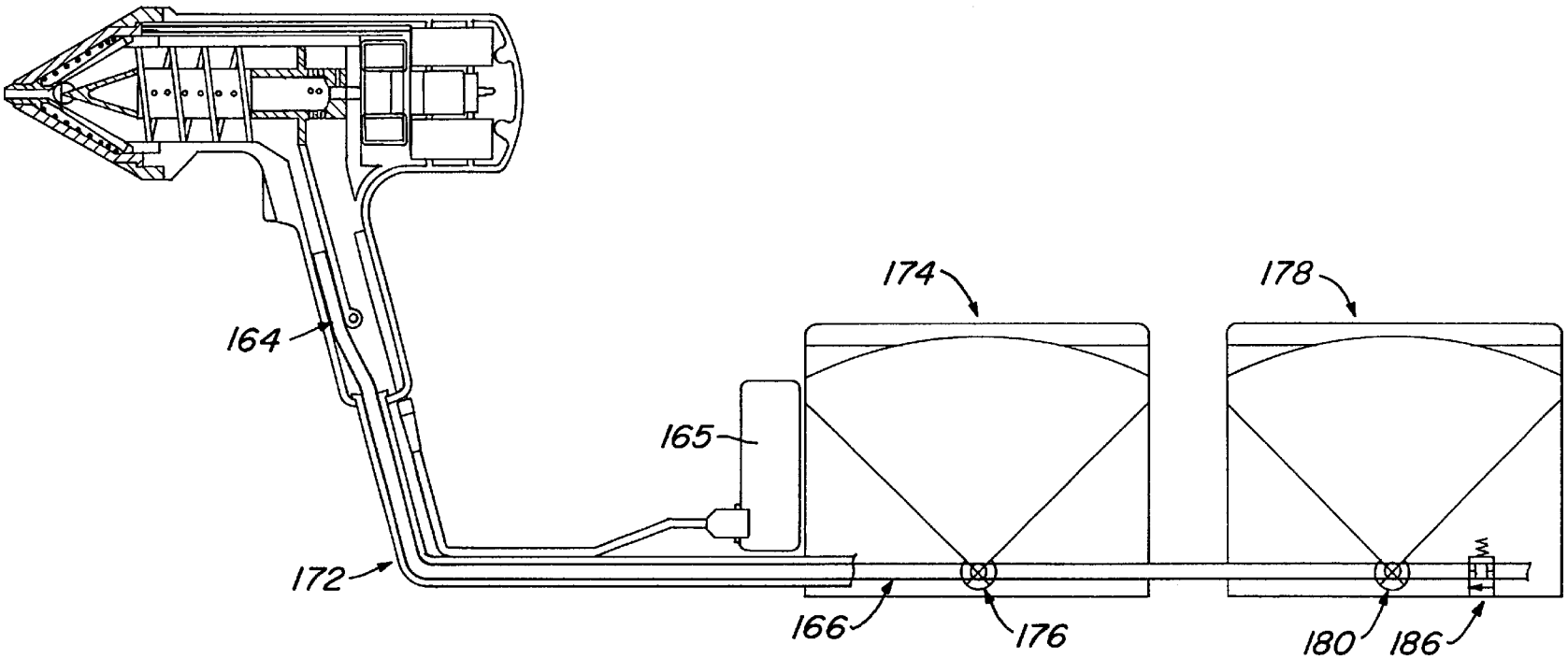
FIG. 7 is a schematic view of the glue gun of FIG. 4 connected to a hopper system.

An inner hose 164 (FIGS. 4 and 7) is provided that connects to a conduit 166 (FIG. 7) supplied with air pressure. Inner hose 164 passes into handle 128 and terminates within integral passage 168 (FIG. 4). Integral passage 168 is formed by barrier 169 in handle 128. Integral passage 168 communicates with interior 118 of body 112 and delivers beads 111 propelled by air pressure to interior 118 of body 112. Beads 111 are delivered to an area proximate feed screw 136. Feed screw 136 delivers beads 111 to the forward end 114 of glue gun 110.

A pervious screw loading system utilizes holes 170 and 171 in the screw barrel 137 to separate the air delivered beads 111 from the returning air. Air used to transport beads 111 is routed through intake holes 170 in screw barrel 137. The air passes through screw barrel 137 and exits through exit holes 171. Intake holes 170 and exit holes 171 are separated by flange 171*a*. These passages 170, 171 along with a negative differential in the hydraulic pressure on the melt face separates the approximately 50% air by volume from the compressing beads 111. The air then passes down a back side of barrier 169 through handle 128 and out through an annulus between outer hose 172 and inner hose 164 for return delivery of the separated airstream.

A PC board in a controller 165 (FIG. 7) has electronics for controlling a forward or rearward rotation of feed screw 136. Additionally, the PC board controls a flow of power over the cable to conical inductor 146.

A first hopper 174 (FIG. 7) is provided to contain beads 111. Hopper 174 is connected to conduit 166 of inner hose 164. Electric metering device 176 is provided within first hopper 174 for placing beads 111 into the airstream of inner hose 164. In one embodiment, a second hopper 178 is provided having an electric metering device 180 upstream from hopper 174.

The rotation of the variable speed feed screw 136 is related to the beads/min metering monitored by devices 176 and 180 from the hopper. The bead metering is interrupted as required by electronically sensing the rising air pressure as more intake holes or air passages 170 in the screw barrel 137 are blocked by the beads 111 that are driven forward by feed screw 136.

First hopper 174 and second hopper 178 may be filled with different kinds of beads 111. Melt phase compounding can be achieved by introducing multiple formulations of reactive beads 111 in variable metering from multiple reservoirs such as hoppers 174 and 178. A percentage of different kinds of beads 111 may be delivered to inner hose 164 so that the resulting melted glue properties may be controlled. An electric valve 186 is provided to further control flow of air to deliver the beads 111. A shift shut down purge of the susceptor 150 and delivery screw 136 can be achieved by forwarding only a singular formulation in the amount of the screw and susceptor volume (typically 0.7 to 1 oz. of material) and rejecting this amount upon restart.

In practice, first hopper 174 and/or second hopper 178 is/are filled with beads 111 of meltable material. Electric metering device 176 and/or 180 allow(s) the appropriate amount of their respective beads 111 to enter inner hose 164. An airstream within hose 164 delivers beads 111 into integral passage 168 and into interior 118 of body 112. Motor 134 rotates screw barrel 137 and feed screw 136. Feed screw 136 delivers beads 111 to a forward end 114 of body 112. Air passes through intake holes 170 of rotatable cylinder or screw barrel 137 and is directed through exit holes 171 for return delivery through outer hose 172.

As discussed above, beads 111 are delivered to forward end 114 of body 112 where beads 111 come in contact with conical susceptor 150. The conical susceptor 150 is heated by magnetic field induction formed by inductor coil 146. Beads 111 in contact with conical susceptor 150 are melted to form the elastic zone 156, as shown in FIG. 5. The melted beads 111 are then delivered through susceptor holes 152, past the inductor coil 146, and out of nozzle 160 for application.

When trigger mechanism 132 is released, motor 134 automatically reverses screw barrel 137 and feed screw 136 approximately 15 degrees to relieve pressure on the elastic zone 156. This action reduces the hydraulic pressure on the down stream liquid zone to abruptly cut off the flow out of the nozzle at the end of an application cycle.

This invention has several advantages. Folding the susceptor enables more energy to be continuously induced into the same diameter susceptor. Therefore, more energy can be transferred to the material at greater production rates. The susceptor's heat transfer efficiency is the major production rate limiting factor without increasing the diameter of the stick.

While the invention has been shown in only one of its forms, it should be apparent to those skilled in the art that it is not so limited, but is susceptible to various changes without departing from the scope of the invention.

What is claimed is:

1. An apparatus for delivering a melted material, comprising:

a body having a nozzle on a forward end and a cavity for receiving the meltable material;

a susceptor adjacent said nozzle for generating heat to melt said meltable material, said susceptor having a plurality of folds; and an induction coil disposed within said body for immersion in said meltable material and adjacent said susceptor for electromagnetically inducing the susceptor to heat said material.

2. The apparatus according to claim 1 further comprising:

a drive member in the cavity for forcing the melted material proximate the susceptor and out said nozzle.

3. The apparatus according to claim 2 wherein:

the drive member is a pusher and said meltable material received in said body is in stick form.

4. The apparatus according to claim 1 wherein:

said susceptor is conical and has a plurality of holes formed thereon including a central orifice for the passage of said meltable material.

5. The apparatus according to claim 1 wherein:

said susceptor is conical, having a circular forward end and a circular rearward end of a larger diameter than said forward end, and wherein said folds extend from the rearward end to the forward end.

6. The apparatus according to claim 5 wherein:

said folds comprise generally v-shaped troughs.

7. An apparatus for delivering a melted material, comprising:

a body having a nozzle on a forward end and a cavity for receiving meltable material;

an electrically conductive conical susceptor adjacent said nozzle for generating heat to melt said meltable material, wherein said susceptor has a plurality of holes therein, said susceptor having folds to provide greater surface area for increasing heat transfer, said folds extending lengthwise from a base of the susceptor to an apex of said susceptor;

an conical induction coil disposed within said body for immersion in said meltable material and adjacent said susceptor for electromagnetically inducing the susceptor to heat said material; and a drive member in the cavity for forcing melted material through the susceptor and out said nozzle.

8. The apparatus according to claim 7 wherein:

the drive member is a pusher and said meltable material received in said body is in stick form.

9. The apparatus according to claim 7 wherein:

said folds are generally v-shaped.

10. An apparatus for delivering a melted material, comprising:

a body having a nozzle on a forward end and a cavity for receiving meltable material;

an electrically conductive conical susceptor adjacent said nozzle for generating heat to melt said meltable material, wherein said susceptor has a plurality of holes therein, said susceptor having generally v-shaped folds to provide greater surface area for increasing heat transfer, said folds extending lengthwise from a base of the susceptor to an apex of said susceptor;

a conical induction coil disposed within said body for immersion in said meltable material and adjacent said susceptor for electromagnetically inducing the susceptor to heat said material; and a pusher in the cavity for forcing a stick of meltable material through the susceptor and out said nozzle.

* * * * *